US005734312A

United States Patent [19]

Czerner et al.

[11] Patent Number: 5,734,312

[45] Date of Patent: Mar. 31, 1998

[54] OVERTEMPERATURE PROTECTION ASSEMBLY FOR AN APPLIANCE

[75] Inventors: Peter A. Czerner, Trumbull; Richard I. Farrington, Seymour; James E. Chasen, West Haven, all of Conn.

[73] Assignee: Black & Decker Inc., Newark, Del.

[21] Appl. No.: 494,513

[22] Filed: Jun. 26, 1995

[51] Int. Cl.[6] ..... H01H 37/00; H01H 37/76

[52] U.S. Cl. ..... 337/403; 337/1; 337/407; 219/253

[58] Field of Search ..... 337/299, 400–409, 337/13, 1; 219/253, 331

[56] References Cited

U.S. PATENT DOCUMENTS

| | | | |
|---|---|---|---|
| 3,198,914 | 8/1965 | Baran et al. | 200/142 |
| 3,436,712 | 4/1969 | Heaney | 337/405 |
| 3,444,355 | 5/1969 | Tyler | 219/331 |
| 3,602,864 | 8/1971 | Burney | 337/407 |
| 3,629,765 | 12/1971 | Gould, Jr. | 337/239 |
| 3,827,015 | 7/1974 | Ball | 337/414 |
| 3,952,274 | 4/1976 | Plasko | 337/407 |
| 3,956,725 | 5/1976 | Merrill et al. | 337/407 |
| 4,025,888 | 5/1977 | Judd et al. | 337/266 |
| 4,297,669 | 10/1981 | Gale | 337/407 |
| 4,366,462 | 12/1982 | Hollweck | 337/409 |
| 4,415,796 | 11/1983 | Baichunas | 219/253 |
| 4,433,231 | 2/1984 | Baichunas | 219/253 |
| 4,451,814 | 5/1984 | Barry et al. | 337/407 |
| 4,472,705 | 9/1984 | Carlson | 337/299 |
| 4,527,144 | 7/1985 | Arikawa | 337/407 |
| 4,533,897 | 8/1985 | Olson et al. | 337/408 |
| 4,536,641 | 8/1985 | Chan | 219/253 |
| 4,652,964 | 3/1987 | Ziegenbein | 361/54 |
| 4,789,800 | 12/1988 | Zimmermann | 310/68 C |
| 4,802,860 | 2/1989 | Kikuta | 439/79 |
| 4,899,124 | 2/1990 | Hollweck | 337/299 |
| 4,929,922 | 5/1990 | Hollweck | 337/407 |
| 5,138,297 | 8/1992 | Hollweck | 337/354 |
| 5,221,914 | 6/1993 | Ubukata et al. | 337/13 |

*Primary Examiner*—Leo P. Picard
*Assistant Examiner*—Jayprakash N. Gandhi
*Attorney, Agent, or Firm*—Barry E. Deutsch

[57] ABSTRACT

An overtemperature protection assembly with a mount, a solder terminal and a bridging connector. The mount is a block of ceramic material with a slot extending therethrough. The solder terminal has an end that is located in the slot and forms a frictional connection therein. The bridging connector has a busing terminal and a spring contact. The busing terminal has an end that is located in the slot. The spring contact has a first end connected to the busing terminal and a second end that is deflected towards the solder terminal and soldered thereto. If the solder connecting the second end of the spring contact to the solder terminal melts from excessive heat, the spring contact deflects away from the solder terminal thereby breaking electrical connection between the solder terminal and the busing terminal.

20 Claims, 3 Drawing Sheets

FIG. 2
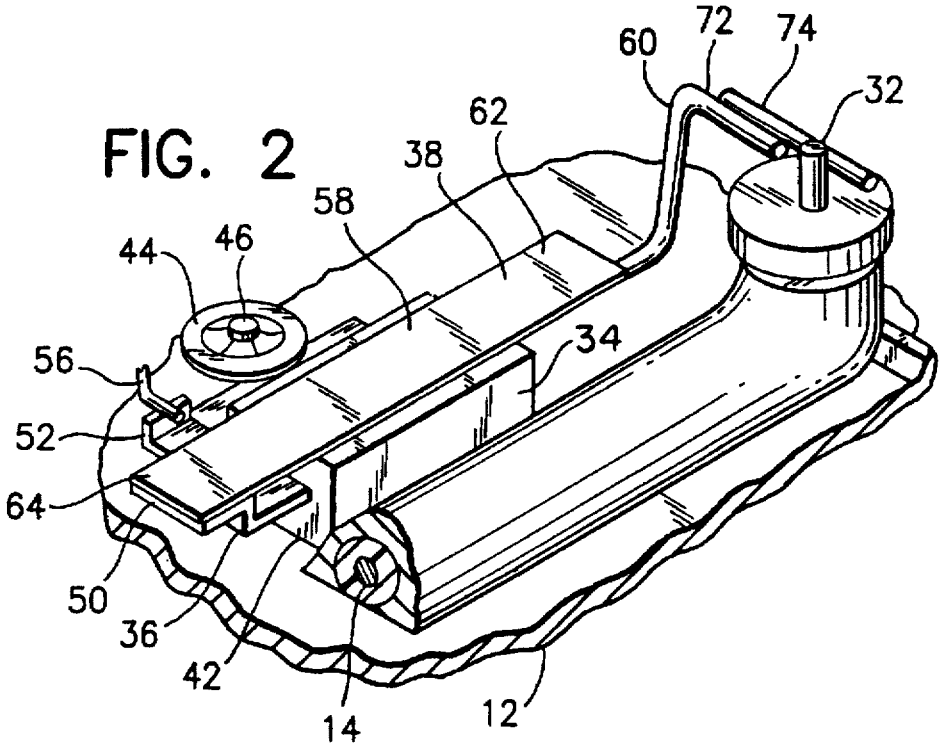
FIG. 3
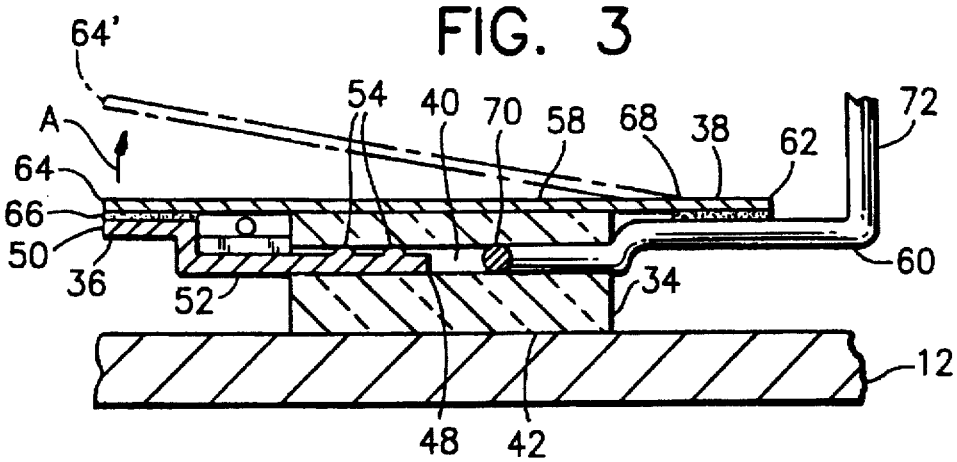
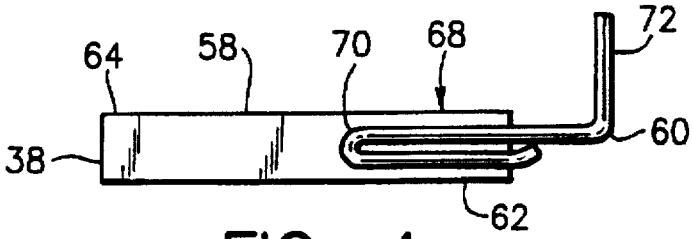
FIG. 4

OVERTEMPERATURE PROTECTION ASSEMBLY FOR AN APPLIANCE

BACKGROUND OF THE INVENTION

1. Field of the Invention

The present invention relates to electrical appliances and, more particularly, to an overtemperature protection assembly.

2. Prior Art

U.S. Pat. Nos. 4,536,641; 4,433,231; 4,415,796; and 3,444,355 disclose electric appliances with overtemperature protection devices. U.S. Pat. No. 4,536,641 specifically discloses an overtemperature limiter for an electric iron that has a ceramic insulating block and rivets that connect a spring contact and circuit members to the ceramic block. The spring contact is deflected and than soldered to one of the circuit members. Other thermal switches or fuses are disclosed in the following U.S. Pat. Nos.:

| | |
|---|---|
| 3,198,914 | 3,436,712 |
| 3,602,864 | 3,629,766 |
| 3,827,015 | 3,952,274 |
| 3,956,725 | 4,297,669 |
| 4,366,462 | 4,451,814 |
| 4,472,705 | 4,527,144 |
| 4,533,897 | 4,652,964 |
| 4,789,800 | 4,899,124 |
| 4,929,922 | 5,138,297 |
| 5,221,914 | |

SUMMARY OF THE INVENTION

In accordance with one embodiment of the present invention, an electric iron is provided having a soleplate, a heater connected to the soleplate, a thermostat operably connected to the heater, and an overtemperature protection assembly electrically connecting the thermostat to the heater. The overtemperature protection assembly comprises a mount, a solder terminal, and a bridging connector. The mount is comprised of electrically insulating material and has a slot therein. The solder terminal is connected to the mount. The bridging connector has a mounting portion and a spring contact portion. The mounting portion connects the bridging connector to the mount in the slot. The spring contact portion extends from the mounting portion to the solder terminal. The contact portion is deflected towards the mount and soldered to the solder tail. The spring contact portion springs away from the solder terminal when a solder connection of the spring contact portion and the solder terminal is melted to thereby break electrical connection between the solder terminal and the bridging connector.

In accordance with another embodiment of the present invention, an overtemperature protection assembly is provided for an electrically powered household appliance. The assembly comprises a mount, a solder terminal, and a bridging connector. The mount is made of ceramic material and has at least one slot therein. The solder terminal is connected to the mount with a first end in the slot and a second end extending out of a first end of the mount. The bridging connector has a first portion with a first end in the slot, spaced from the solder terminal, and a second end extending out of a second end of the mount. A second portion extends from the first portion to the solder terminal. The second portion is deflected towards the solder terminal and fixedly connected to the solder terminal by solder.

In accordance with one method of the present invention, a method of assembling an overtemperature control assembly for an electrical appliance is provided comprising steps of providing a mount made of dielectric material with at least one slot therein; mounting a spring connector to the mount by inserting an end of the spring connector into an end of the slot; deflecting a portion of the spring connector towards a solder terminal connected to the mount; and soldering the portion of the spring connector the solder terminal.

BRIEF DESCRIPTION OF THE DRAWINGS

The foregoing aspects and other features of the invention are explained in the following description, taken in connection with the accompanying drawings, wherein:

FIG. 2 is a partial perspective view of the overtemperature protection assembly shown in FIG. 1 with portions of the soleplate and heater;

FIG. 3 is a partial cross-sectional view of the soleplate and overtemperature protection assembly shown in FIG. 2;

FIG. 4 is a bottom plan view of the bridging connector used in the overtemperature protection assembly shown in FIG. 3.

DETAILED DESCRIPTION OF THE PREFERRED EMBODIMENT

Figure 1:
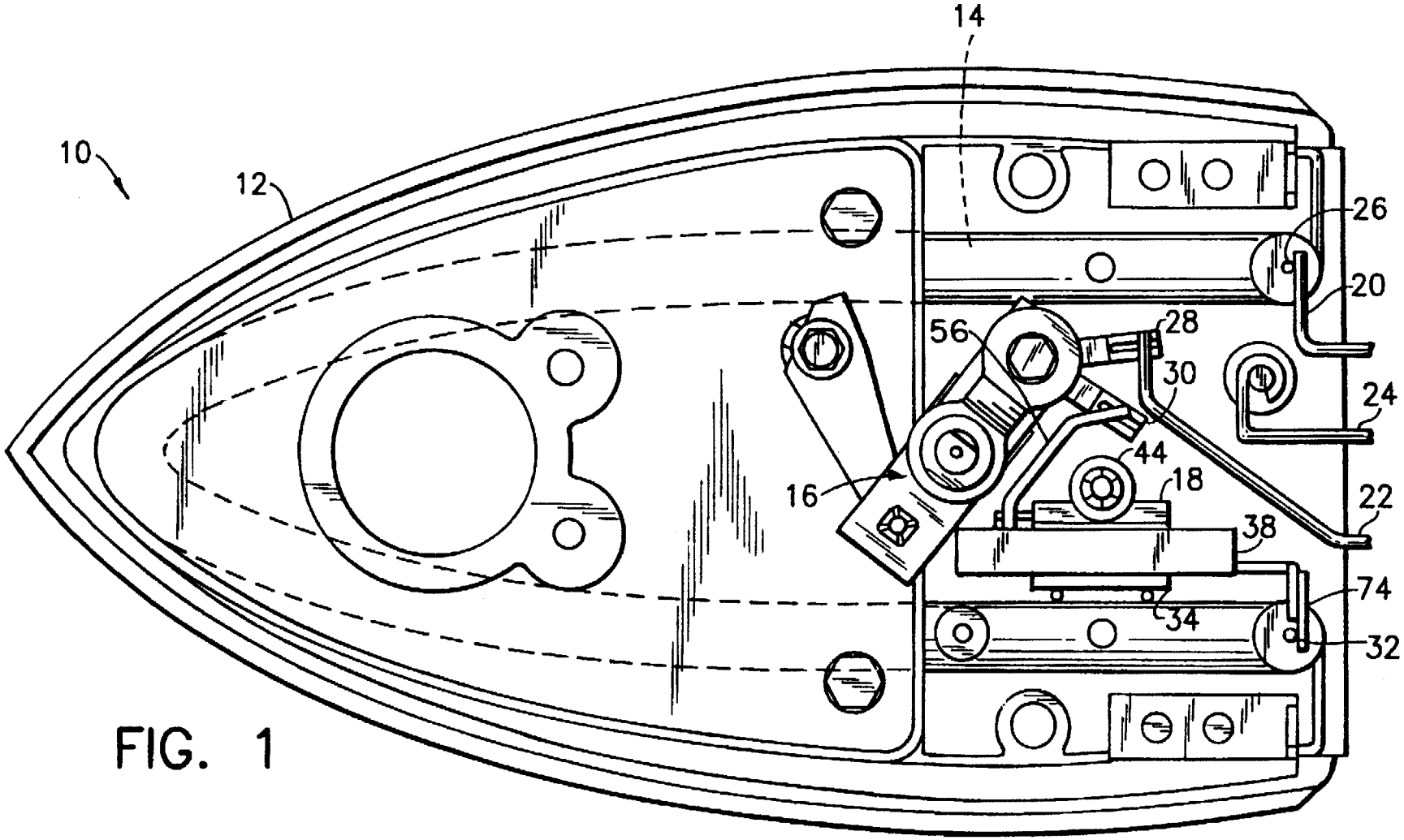
FIG. 1 is a top plan view of a soleplate of an electric iron with a heater, a thermostat, and an overtemperature protection assembly incorporating features of the present invention.

Referring to FIG. 1, there is shown a plan top view of a portion of an electric iron 10 incorporating features of the present invention. Although the present invention will be described with reference to the single embodiment shown in the drawings, the present invention may be embodied in many alternative forms of embodiments. In addition, the overtemperature protection assembly of the present invention may be incorporated into any suitable type of electric appliance. Any suitable size, shape or type of elements or materials could also be used.

The electric iron 10 is similar to the iron shown in U.S. Pat. No. 4,536,641 which is hereby incorporated by reference in its entirety. The iron 10 has a soleplate 12, a heater 14, a thermostat 16, and an overtemperature protection assembly 18. The heater 14 is an electric heating element that is cast in position in the soleplate 12. The soleplate 12 is preferably comprised of cast aluminum. The iron preferably also has means for steam generation (not shown). The iron is connected to an electrical outlet by a suitable electric cord (not shown). The electric cord is connected to an IN conductor 20, an OUT conductor 22, and a ground conductor 24. The IN conductor 20 is connected to an IN terminal pin 26 of the heater 14. The OUT conductor 22 is connected to an OUT terminal 28 of the thermostat 16. The ground conductor 24 is connected to the soleplate 12.

The overtemperature protection assembly 18 is electrically connected between an IN terminal 30 of the thermostat 16 and an OUT terminal pin 32 of the heater 14. Referring also to FIGS. 2–4, the overtemperature protection assembly 18 generally comprises a mount 34, a solder terminal 36, and a bridging connector 38. The mount 34 is preferably comprised of a ceramic material to withstand the heat from the heater 14 and soleplate 12, transfer heat from the soleplate to the rest of the assembly 18, and to function as an electrical insulator or dielectric. The mount 34, in the embodiment shown, has a block-like shape with a single slot 40 extending therethrough. The slot 40 is enclosed except at two opposite ends of the slot 40. In alternate embodiments, other shapes of mounts could be provided and more than one slot could be provided. The soleplate 12 has a receiving area 42 that receives the mount 34.

Figure 5:
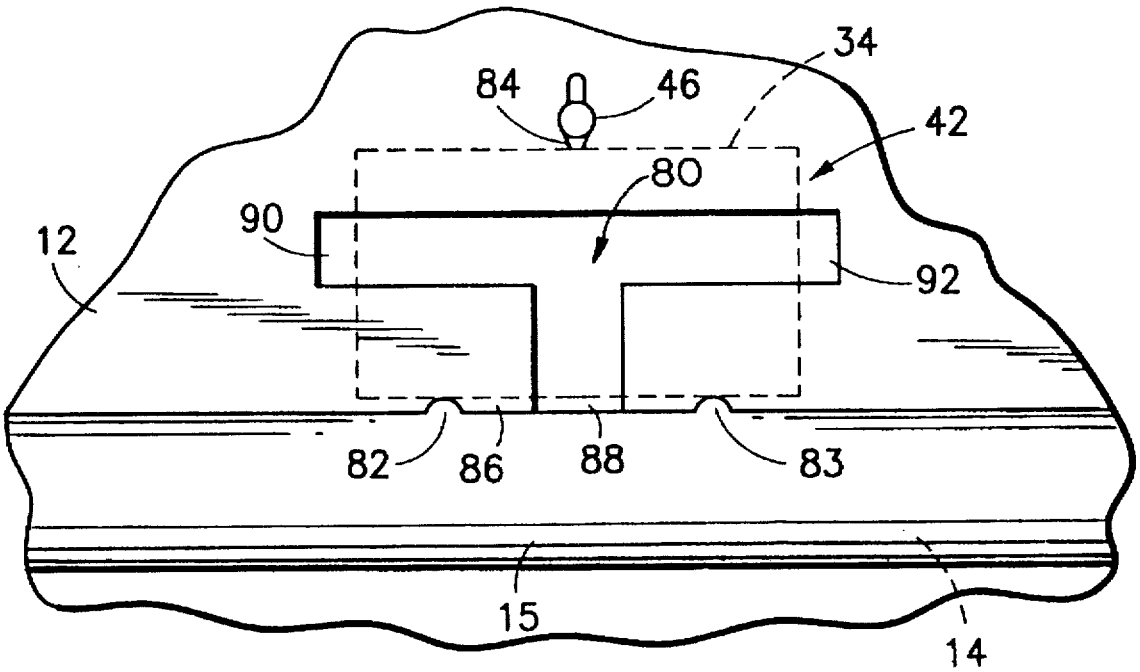
FIG. 5 is a partial schematic top view of the soleplate at the receiving area of the overtemperature protection assembly.

Referring also to FIG. 5, there is shown a partial schematic top view of the soleplate 12 at the receiving area 42. The mount 34 is shown in dashed lines. The soleplate 12 includes a "T" shaped pocket 80 on its top surface that extends from the raised portion 15 of the soleplate 12 that houses the heater 14. Extending laterally from the raised portion 15 are two spacer ribs 82, 83. Extending laterally from the post 46 is a spacer rib 84. When the mount 34 is located in the receiving area 42 it is sandwiched between the ribs 82, 83 and 84. A gap 86 is established by the ribs 82, 83 between the mount 34 and the raised portion 15 to allow air to pass through the gap 86. This allows air to enter and/or exit the bottom 88 of the "T" shaped pocket 80. The top of the "T" shaped pocket 80 is longer than the length of the mount 34. Therefore, two open ends 90, 92 are established at the opposite ends of the mount 34. The bottom end 88 and the opposite open top ends 90, 92 provide for convective air flow underneath the mount 34. The geometry of the pocket can be selected to get the correct amount of heat transfer for the overtemperature limiter being used. The pocket 80 forms an insulation barrier for preventing too much heat transfer from the soleplate 12 to the mount 34 that could otherwise result in premature opening of the assembly 18 during normal operation. The open ends 90, 92 also provide for additional air cooling of the mount. In alternate embodiments, alternative or additional insulating means could be provided as well as alternative or additional cooling means.

Referring back to FIGS. 1 and 2, a fastener 44 is connected to the soleplate 12 on a post 46. A portion of the mount 34 is stationarily sandwiched between the fastener 44 and the soleplate 12 in the receiving area 42. This stationarily connects the mount 34 to the soleplate 12. In alternate embodiments, other types of means to connect the mount to the soleplate could be provided.

The solder terminal 36 is a one-piece metal member and includes a first end 48, a second end 50 and a side extension 52. The first end 48 is suitably sized and shaped to be inserted into the slot 40. The first end 48 includes interference projections 54 on its top. When the first end 48 is inserted into the slot 40, the projections 54 cause the bottom surface of the first end 48 to engage the bottom surface of the slot 40. This causes an interference frictional connection between the solder terminal 36 and the mount 34. In alternate embodiments, alternative or additional means to connect the solder terminal to the mount could be provided. The side extension 52 has a conductor 56 connected thereto. The conductor 56 electrically connects the solder terminal 36 to the IN terminal 30 of the thermostat 16. The second end 50 is located outside of the slot 40 on one end of the mount 34. The second end 50 is elevated to a higher plane than the first end 48 that is slightly below the top of the mount 34.

The bridging connector 38, in the embodiment shown, is comprised of a spring contact 58 and a busing terminal 60. The spring contact 58 is a one-piece metal member with a first end 62 and a second end 64. The first end 62 is fixedly connected to the busing terminal 60, such as by welding. The second end 64 is fixedly connected to the second end 50 of the solder terminal 36 by solder 66. The solder 66 both mechanically and electrically connects the solder terminal 36 to the bridging connector 38. The spring contact 58, in a home position (i.e., when not connected to the solder plate 36 by the solder 66) has a bend at area 68 and a shape as shown by dotted lines in FIG. 3. However, with the spring contact 58 connected to the solder terminal 36, the spring contact has a substantially flat shape. The busing terminal 60 is a one piece metal member with a first end 70 and a second end 72. The first end 70 has a general U-shape. The first end 70 is suitably sized and shaped to be inserted in the slot 40 of the mount 34. The second end 72 extends towards the OUT terminal pin 32 of the heater 14. A conductor 74 electrically connects the second end 72 to the OUT terminal pin 32. Thus, an electrical path is established from the OUT terminal pin 32, through the conductor 74, through the busing terminal 60, through the spring contact 58, through the solder 66, through the solder plate 36, and through the conductor 56 to the IN terminal 30 of the thermostat 16.

The operation of the overtemperature protection assembly 18 is relatively simple. During normal use of the iron 10, the assembly merely functions as a conductor in an electrical circuit between the heater 14 and the thermostat 16. However, if the iron gets too hot the solder 66 will melt. When the solder 66 melts, the mechanical connection holding the second end 64 of the spring contact 58 to the second end 50 of the solder terminal 36 is broken. The stored potential energy in the spring contact 58, from being deflected into a flat shape, is then able to be released. The second end 64 springs upward as indicated by arrow A in FIG. 3 to the position 64'. The position 64' is spaced from the solder terminal 36. Thus, the electrical connection between the solder terminal 36 and the spring contact 58 is broken. This breaks the circuit path between the heater 14 and the thermostat 16 thereby shutting the iron off until repaired by a qualified service center.

The assembly of the present invention is reliably constructed, is compact in size and, is inexpensive to manufacture. A solder overtemperature protection apparatus is one of the most simple and dependable forms of overtemperature protection. With the present invention, the overtemperature protection assembly 18 consists of the solder 66 and only four parts: the mount 34, the solder terminal 36, the spring contact 58 and the busing terminal 60. The use of only four parts reduces manufacturing costs. The need for only four parts also reduces assembly time and costs.

To assemble the overtemperature protection assembly 18, the solder terminal 36 is mounted to the mount 34 by merely inserting the first end 48 into the slot 40. Frictional engagement between the mount 34 and the first end 48 keeps the solder terminal connected to the mount 34. The spring contact 58 is connected to the busing terminal 60. The first end 70 of the busing terminal 60 is inserted in the opposite end of the slot 40. The second end 64 of the spring contact 58 is then deflected towards the second end 50 of the solder terminal 36. The spring contact 58 deforms at area 68 into a substantially flat shape. The solder 66 is melted between the two second ends 64 and 50 and then allowed to cool. Assembly of the assembly 18 is then complete. Because of the location of the end 70 in the slot and connection of end 64 to solder terminal 36, no fasteners are needed to connect the bridging connector 38 to the mount 34. Likewise, because of the engagement of the first end 48 of the solder terminal 36 in the slot 40, no fasteners are needed to connect the solder terminal 36 to the mount 34. This obviously saves time and money during manufacture. In an alternate embodiment, the bridging connector might be provided as a one-piece member. In another alternate embodiment, the conductors 74 and 56 could be replaced by the assembly being directly connected between the heater and the thermostat. The present invention could also be combined with a thermostat as a single assembly.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electric iron having a soleplate, a heater connected to the soleplate, a thermostat, and an overtemperature protection assembly electrically connecting the thermostat to the heater, the overtemperature protection assembly comprising:

a mount comprised of electrical insulating material, the mount having a slot therein, said slot extending entirely through said mount;

a solder terminal connected to the mount; and a bridging connector having a mounting portion and a spring contact portion, the mounting portion connecting the bridging connector to the mount in the slot, the spring contact portion extending from the mounting portion to the solder terminal, the spring contact portion being deflected towards and soldered to the solder terminal, wherein the spring contact portion springs away from the solder terminal when a solder connection of the spring contact portion and the solder terminal is melted to thereby break electrical connection between the solder terminal and the bridging connector.

2. An electric iron as in claim 1 wherein the mount is comprised of ceramic material.

3. An electric iron as in claim 1 wherein the slot is enclosed except for openings at opposite ends of the mount.

4. An electric iron as in claim 1 wherein the mount has a block shape and the soleplate has a receiving area for receiving the mount.

5. An electric iron as in claim 4 further comprising a fastener connected to the soleplate that stationarily sandwiches a portion of the mount between the fastener and a portion of the soleplate.

6. An electric iron as in claim 1 wherein the solder terminal has an end that is located in the slot that connects the solder terminal to the mount.

7. An electric iron as in claim 6 wherein the end of the solder terminal makes frictional mounting engagement with the mount in the slot.

8. An electric iron as in' claim 1 wherein the mounting portion of the bridging connector makes a frictional mounting engagement with the mount in the slot.

9. An electric iron as in claim 1 wherein the bridging connector comprises a solder blade fixedly connected to a bus terminal, the solder blade forming the spring contact portion and the bus terminal forming the mounting portion.

10. An electric iron as in claim 1 wherein the spring contact portion has a substantially straight shape when connected to the solder terminal.

11. An electric iron as in claim 1 wherein the soleplate has a receiving area with a pocket along a surface.

12. An electric iron as in claim 11 further comprising means for air cooling the mount which includes the pocket.

13. An electric iron as in claim 11 further comprising means for thermally insulating a portion of the mount from the soleplate.

14. An electric iron as in claim 11 wherein the pocket has a general "T" shape.

15. An overtemperature protection assembly for an electrically powered household appliance, the assembly comprising:

a mount comprised of ceramic material, the mount having at least one slot therein; said slot extending entirely through said mount;

a solder terminal connected to the mount with a first end in the slot and a second end located outside of the mount at a first end of the mount; and a bridging connector having a first portion with first end in the slot spaced from the solder terminal and a second end located outside of the mount at a second end of the mount, and a second portion extending from the first portion to the solder terminal, the second portion being deflected towards the solder terminal and fixedly connected to the solder terminal by solder.

16. An assembly as in claim 15 wherein the slot is enclosed except for openings at the first and second ends of the mount.

17. An assembly as in claim 15 wherein the first end of the solder terminal makes frictional mounting engagement with the mount in the slot.

18. An assembly as in claim 15 wherein the first portion of the bridging connector is fictionally mounted to the mount in the slot.

19. An assembly as in claim 15 wherein the bridging connector comprises a solder blade fixedly connected to a bus terminal, the solder blade forming the second portion and the bus terminal forming the first portion.

20. An assembly as in claim 15 wherein the second portion has a substantially straight shape when connected to the solder terminal.

* * * * *